US010533570B2

(12) United States Patent
Ruzicka et al.

(10) Patent No.: US 10,533,570 B2
(45) Date of Patent: Jan. 14, 2020

(54) OPPOSED IMPELLER WEAR RING UNDERCUT TO OFFSET GENERATED AXIAL THRUST IN MULTI-STAGE PUMP

(71) Applicant: Fluid Handling LLC, Morton Grove, IL (US)

(72) Inventors: Paul J. Ruzicka, Auburn, NY (US); Christopher J. Felix, Farmington, NY (US)

(73) Assignee: Fluid Handling LLC, Morton Grove, IL (US)

( * ) Notice: Subject to any disclaimer, the term of this patent is extended or adjusted under 35 U.S.C. 154(b) by 321 days.

(21) Appl. No.: 15/371,878

(22) Filed: Dec. 7, 2016

(65) Prior Publication Data

US 2017/0184115 A1 Jun. 29, 2017

Related U.S. Application Data

(60) Provisional application No. 62/263,982, filed on Dec. 7, 2015.

(51) Int. Cl.
*F04D 29/16* (2006.01)
*F04D 29/08* (2006.01)
(Continued)

(52) U.S. Cl.
CPC ..... *F04D 29/167* (2013.01); *F04D 29/041* (2013.01); *F04D 29/08* (2013.01);
(Continued)

(58) Field of Classification Search
CPC ..... F04D 29/167; F04D 29/041; F04D 29/08; F04D 29/2266; F04D 1/06; B63H 11/08
See application file for complete search history.

(56) References Cited

U.S. PATENT DOCUMENTS 2,440,947 A 5/1948 Hart
3,105,632 A * 10/1963 Tanzberger ..... F04D 17/125 415/199.1
(Continued)

FOREIGN PATENT DOCUMENTS

FR 2599092 A1 11/1987
FR 2921445 A1 3/2009
(Continued)

OTHER PUBLICATIONS

"MSD Multi-Stage Dual Volute Pumps," Sulzer, sulzer.com, Dec. 10, 2015. https://web.archive.org/web/20151210155710/http://www.sulzer.com/en/-/media/Documents/ProductsAndServices/Pumps_and_Systems/Axially_Split_Pumps/Presentations/MSD_presentation.pdf.
(Continued)

*Primary Examiner* — Syed O Hasan
(74) *Attorney, Agent, or Firm* — Ware, Fressola, Maguire & Barber LLP

(57) ABSTRACT

An opposing impeller arrangement, for using in an opposed impeller pump, features a combination of a stage 1 impeller arrangement and a stage 2 impeller arrangement having opposing impellers and different impeller and wear ring arrangements. The stage 1 impeller arrangement may include a stage 1 impeller and a stage 1 wear ring, and be configured to receive an input fluid flow and a pump stage 1 fluid flow. The stage 2 impeller arrangement may include a stage 2 impeller and a stage 2 wear ring configured to receive the pump stage 1 fluid flow and provide a pump stage 2 fluid flow, and may also include a stage 2 wear ring undercut configured between the stage 2 impeller and the stage 2 wear ring to offset generated axial thrust in the opposing impeller pump, based upon the different impeller and wear ring arrangements.

10 Claims, 6 Drawing Sheets

A multi-stage opposed impeller

(51) Int. Cl.

| | |
|---|---|
| ***F04D 29/041*** | (2006.01) |
| ***F04D 29/22*** | (2006.01) |
| *B63H 11/08* | (2006.01) |
| *F04D 1/06* | (2006.01) |
| *F04D 29/28* | (2006.01) |

(52) U.S. Cl.
CPC ..... *F04D 29/2266* (2013.01); *B63H 11/08* (2013.01); *F04D 1/06* (2013.01); *F04D 29/281* (2013.01); *F04D 29/284* (2013.01)

(56) References Cited

U.S. PATENT DOCUMENTS

| | | | | |
|---|---|---|---|---|
| 3,225,692 | A * | 12/1965 | Oakes | B41F 13/20 101/375 |
| 3,589,827 | A * | 6/1971 | Gerasimenko | F04D 29/042 415/106 |
| 3,918,831 | A | 11/1975 | Grennan | |
| 4,037,985 | A | 7/1977 | Karassik et al. | |
| 4,063,846 | A * | 12/1977 | Eagle | F04D 29/2266 384/425 |
| 4,208,166 | A | 6/1980 | Schroeder et al. | |
| 4,421,456 | A | 12/1983 | Huffman | |
| 4,439,982 | A | 4/1984 | Weiler et al. | |
| 4,527,948 | A | 7/1985 | Addie | |
| 4,793,777 | A * | 12/1988 | Hauenstein | F04D 29/0416 417/365 |
| 5,248,245 | A | 9/1993 | Behnke et al. | |
| 5,873,697 | A | 2/1999 | Gully | |
| 5,915,921 | A | 6/1999 | Sabini | |
| 6,234,748 | B1 | 5/2001 | Brown et al. | |
| 6,264,440 | B1 * | 7/2001 | Klein | F04D 29/0413 415/106 |
| 6,997,686 | B2 * | 2/2006 | Agrawal | F04D 17/12 417/250 |
| 7,429,160 | B2 | 9/2008 | Roudnev et al. | |
| 7,544,041 | B2 | 6/2009 | Mayleben et al. | |
| 7,785,082 | B2 | 8/2010 | Mitsuda et al. | |
| 7,988,411 | B2 | 8/2011 | Lienau et al. | |
| 8,398,361 | B2 | 3/2013 | Sagoo et al. | |
| 8,419,347 | B2 | 4/2013 | Pomfret | |
| 8,870,521 | B2 | 10/2014 | Brecht et al. | |
| 9,188,134 | B2 | 11/2015 | Ure | |
| 2001/0007632 | A1 | 7/2001 | Pesek et al. | |
| 2003/0180142 | A1 | 9/2003 | Onoda et al. | |
| 2007/0160465 | A1 | 7/2007 | Roudnev et al. | |
| 2007/0280823 | A1 | 12/2007 | Kanemori | |
| 2012/0156012 | A1 | 6/2012 | Ure Villoria | |
| 2013/0209225 | A1 | 8/2013 | Eslinger | |
| 2014/0037440 | A1 | 2/2014 | Frater et al. | |
| 2015/0156012 | A1 | 6/2015 | Alahmadi et al. | |
| 2015/0260190 | A1 | 9/2015 | Bergamini | |

FOREIGN PATENT DOCUMENTS

| | | | |
|---|---|---|---|
| JP | 2014214714 | A | 11/2014 |
| KR | 101537714 | B1 | 7/2015 |
| WO | 9804837 | A1 | 2/1998 |

OTHER PUBLICATIONS

"DMX Between Bearings, Axially Split, Multistage Pump," Flowserve, eee.flowserve.com, May 2014. http://www.flowserve.com/files/Files/Literature/ProductLiterature/Pumps/ps-30-3-e.pdf.
"Radial & Axial Thrust in Centrifugal Pumps," KelairPumps, kelairpumps.com.au, Dec. 9, 2006. http://www.kelairpumps.com.au/images/stories/PDF/PumpClinic/PumpClinic12.pdf.
Marscher, William D., "Avoiding Failures in Centrifugal Pumps," Proceedings of the International Pump Users Symposium. 2002. http://www.turbolab.tamu.edu/proc/pumpproc/P19/15.pdf.
English Language Abstract of KR101537714B1.
English Language Abstract of JP2014214714(A).
English Language Abstract of FR2599092(A1).
English language Abstract of FR2921445.

* cited by examiner

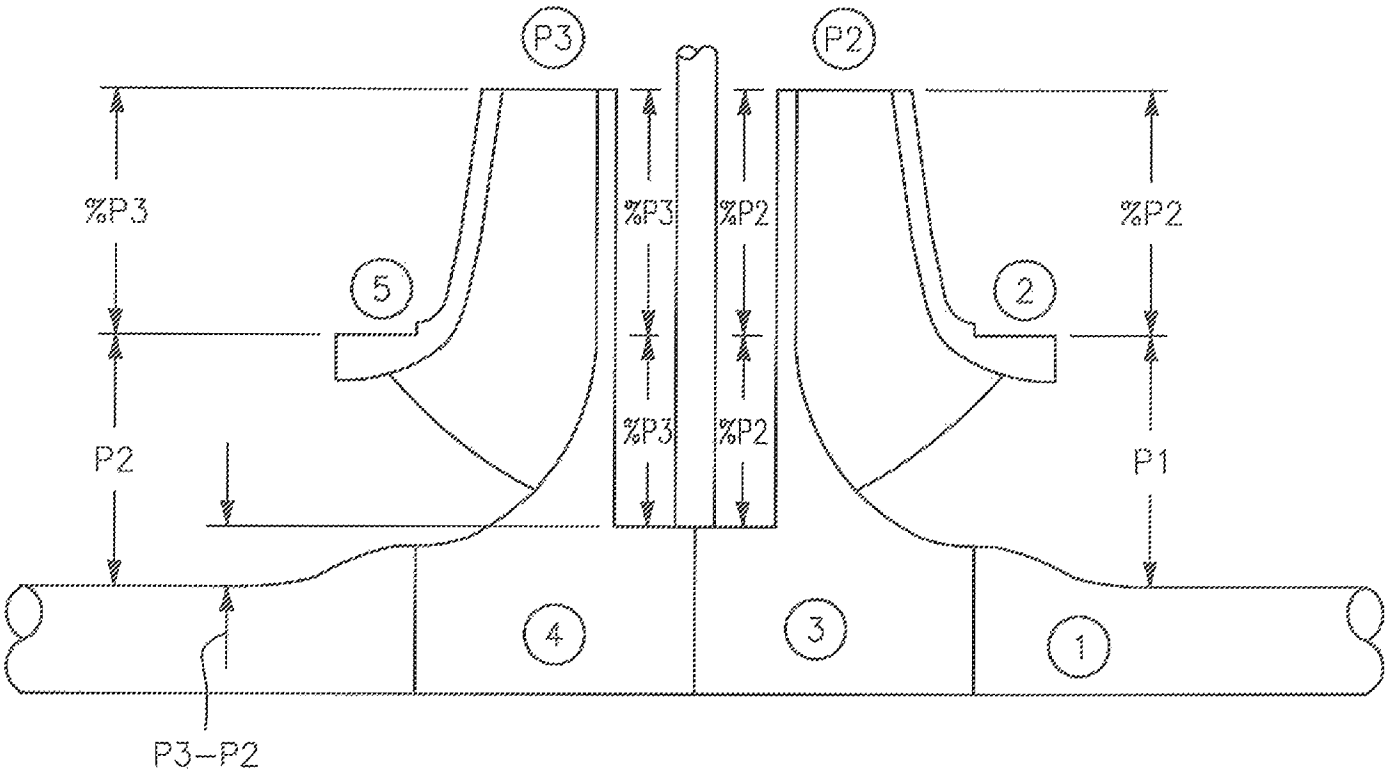
*FIG. 1:* Conventional multi-stage opposed impeller (PRIOR ART)

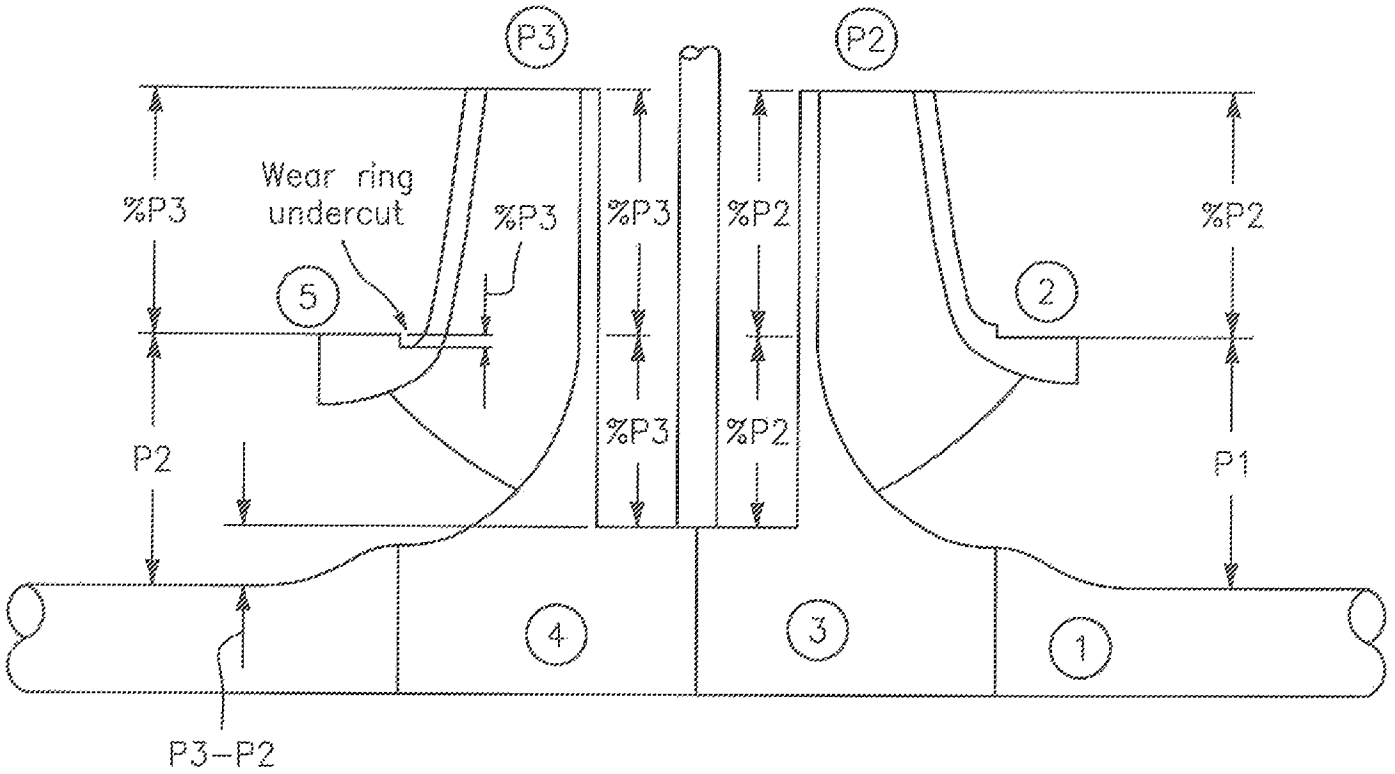
FIG. 2: A multi-stage opposed impeller

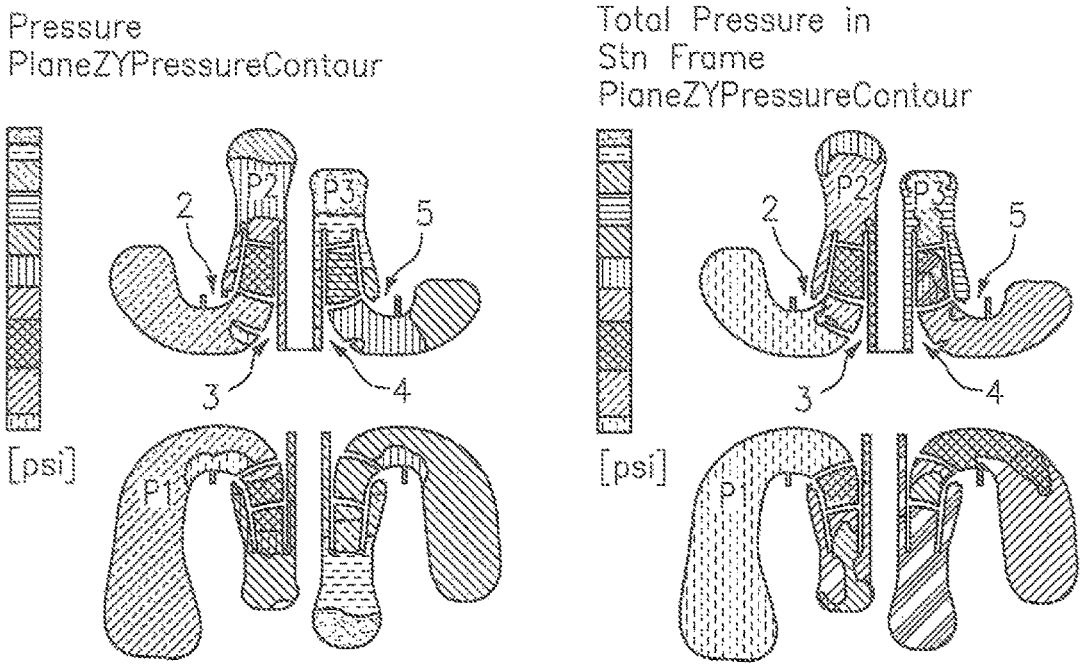
*FIG. 3A* (Static)
*FIG. 3B* (Total)
*FIG. 3*: CFD Analysis showing point of higher pressure (in psi) behind undercut according to the present invention

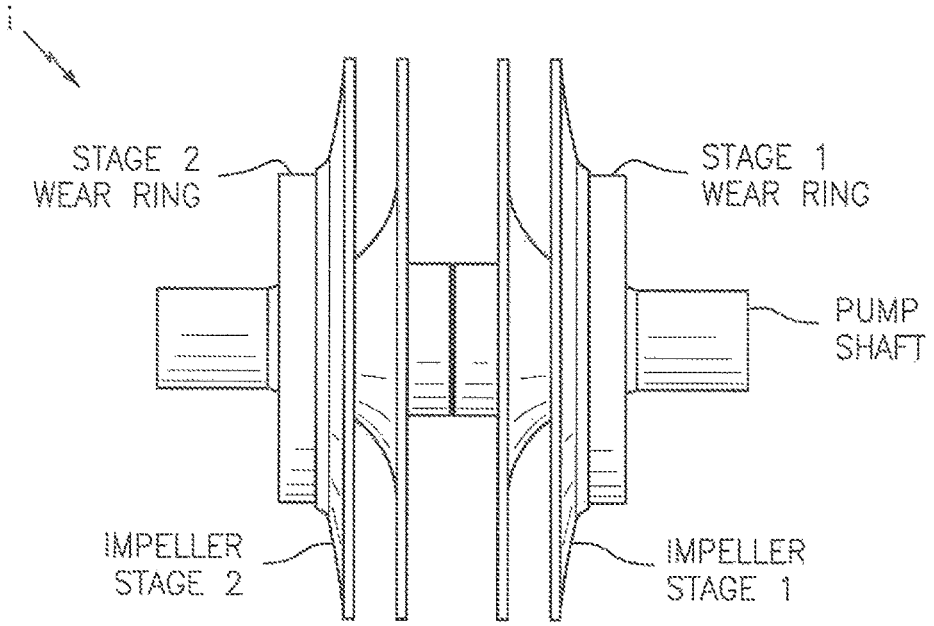
*FIG. 4*: Conventional opposed multistage design (PRIOR ART)
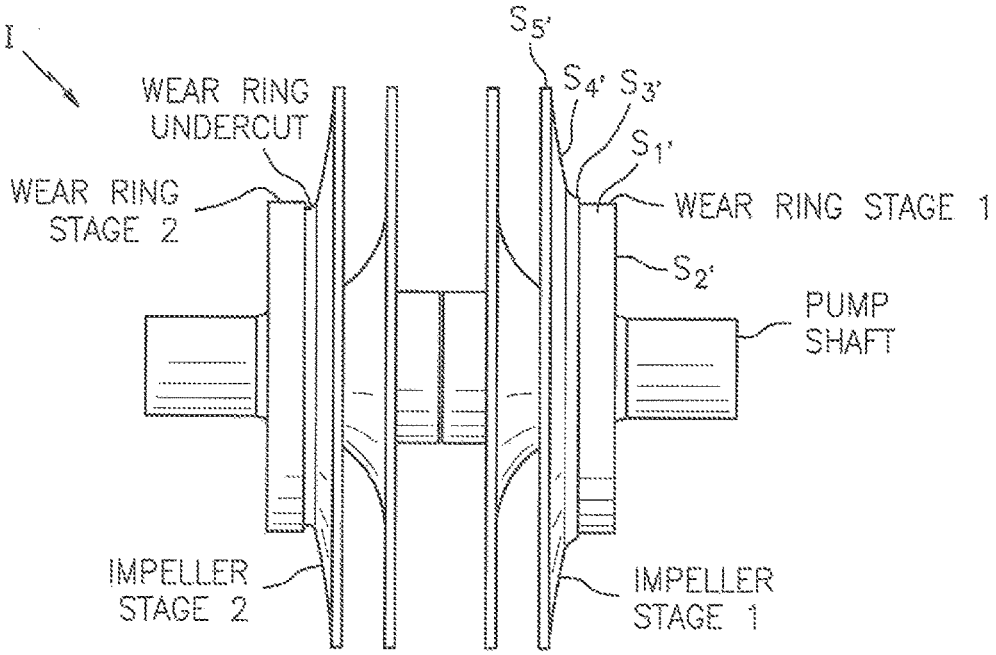
*FIG. 5*: A multi-stage opposed impeller

OPPOSED IMPELLER WEAR RING UNDERCUT TO OFFSET GENERATED AXIAL THRUST IN MULTI-STAGE PUMP

CROSS-REFERENCE TO RELATED APPLICATION

This application claims benefit to provisional patent application Ser. No. 62/263,982, filed 7 Dec. 2015, which is hereby incorporated by reference in its entirety.

BACKGROUND OF THE INVENTION

1. Field of the Invention

The present invention relates to an opposed impeller arrangement; and more particularly relates to a pump having such an opposed impeller arrangement.

2. Brief Description of Related Art

By way of example, FIG. 1 shows part of a conventional multi-stage opposed impeller i (see FIG. 4) that is known in the art and includes a shaft labelled as 1, a stage 1 impeller labelled as 3 and a stage 2 impeller labelled as 4. FIG. 1 also shows the stage 1 wear ring diameter labelled as 2 and the stage 2 wear ring diameter labelled as 5. (In FIG. 1, all five of these reference labels appear in a circle). FIG. 1 shows the suction pressure P1 into the stage 1 inlet, the stage 1 discharge pressure P2 and the stage 2 discharge pressure P3; pressure percentages (e.g., indicated by arrows and pressure indicators P1, P2, % P2, % P3), e.g., between P1 and % P2 for stage 1 and between for P2 and % P3 for stage 2; and a pressure differential indicated by an arrow labeled P3–P2.

FIG. 4 shows the conventional multi-stage opposed impeller i having the stage 1 wear ring, the stage 2 wear ring, the impeller stage 1, the impeller stage 2, e.g., arranged on the pump shaft.

In the prior art, and consistent with that shown in FIGS. 1 and 4, a normal multi-stage opposed impeller pump utilizes two or more impellers that may or may not be of identical design and construction with the inlets in opposite directions. In some cases the second stage inlet may have a different size than the first stage inlet. These inlets are called the eye of the impeller. If the impellers are of the same design and construction it helps to reduce radial and axial forces generated within the pump and through the operating range. However, some design may make the stage 1 inlet to be designed for improved suction performance and as a result may have a larger impeller eye diameter. The second stage eye may be smaller due to the fact that it is receiving pressure from the first stage discharge which helps to prevent cavitation, and to improve overall pump efficiency.

Some of the shortcomings of the above mentioned devices include the following: Having 2 identical impellers helps to reduce the axial forces generated but typically there is still an imbalance due to the higher pressure located at the inlet of the second stage. When the impellers have a different size inlet, this allows for an even greater imbalance in axial forces, but can also lead to a difference in design of the second stage wear ring, additional components, and complexity. If the same wear ring is not used, a second wear ring will need to be used which now increases the axial imbalance and may make the machining of the pump casing more complex.

There is a need in the industry for a better way to configure these known impellers presently used in multi-stage opposed impeller pumps.

SUMMARY OF THE INVENTION

According to some embodiments, and by way of example, the present invention may include, or take the form of, an opposing impeller arrangement, e.g., for using in an opposed impeller pump, featuring a combination of a stage 1 impeller arrangement and a stage 2 impeller arrangement having opposing impellers and different impeller and wear ring arrangements.

The stage 1 impeller arrangement may include a stage 1 impeller and a stage 1 wear ring, and be configured to receive an input fluid flow and a pump stage 1 fluid flow.

In contrast, the stage 2 impeller arrangement may include a stage 2 impeller and a stage 2 wear ring configured to receive the pump stage 1 fluid flow and provide a pump stage 2 fluid flow, and may also include a stage 2 wear ring undercut configured between the stage 2 impeller and the stage 2 wear ring to offset generated axial thrust, e.g., in an opposing impeller pump, based upon the different impeller and wear ring arrangements.

According to some embodiments, the present invention may also include one or more of the following features:

The stage 2 wear ring may include a stage 2 outer circumferential wear ring surface arranged between opposing stage 2 planar wear ring surfaces, one opposing stage 2 planar wear ring surface facing towards the stage 2 impeller; and the stage 2 impeller may be configured with a stage 2 curved impeller surface that slopes towards and meets the stage 2 wear ring on the one opposing stage 2 planar wear ring surface facing the stage 2 impeller so as to form the stage 2 wear ring undercut.

The outer circumferential wear ring surface may have an outer diameter; and the stage 2 wear ring undercut may have a corresponding outer diameter that is less than the outer diameter of the outer circumferential wear ring surface.

By way of further example, the present invention may take the form of an opposed impeller pump featuring an opposing impeller arrangement, e.g., consistent with that set forth herein. The opposed impeller pump may include, or take the form of, a multistage pump.

BRIEF DESCRIPTION OF THE DRAWING

The drawing, which is not necessarily drawn to scale, includes the following Figures:

FIG. 1 shows a diagram of part of a conventional multi-stage opposed impeller that is known in the art.

FIG. 2 shows a diagram of part of a multi-stage opposed impeller having an impeller stage 2 with a wear ring undercut, according to some embodiments of the present invention.

FIG. 3 is a CFD Analysis showing point of higher pressure (in psi) behind the stage 2 wear ring undercut according to the present invention, and includes FIG. 3A showing static pressure and FIG. 3B showing total pressure. (In FIGS. 3A and 3B, various psi(s) are shown in grayscale in respective columns from top to bottom, e.g., with lighter grayscale coloration generally corresponding to a lower psi (top), and darker grayscale coloration generally corresponding to a higher psi (bottom); and corresponding static pressure and total pressure contours are shown in corresponding grayscale as well.) In FIG. 3, Stage 2 appears on the right side of FIGS. 3A and 3B, and Stage 1 appears on the left side of FIGS. 3A and 3B, FIG. 4 is a side view of a conventional multi-stage opposed impeller that is known in the art.

FIG. 5 is a side view of an opposed impeller having an impeller stage 2 with a wear ring undercut, according to some embodiments of the present invention.

FIGURE LABELS

Figure 5A:
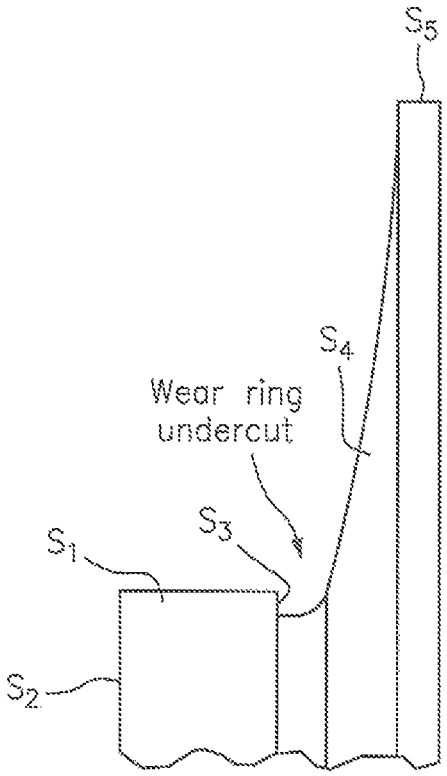
FIG. 5A is an exploded view of a portion of the impeller stage 2 wear ring undercut shown in FIG. 5.

The following is a list of Figure labels used in the drawing:

Some pressures are labeled:

P1: Suction Pressure into Stage 1 inlet;

P2: Stage 1 Discharge Pressure and

P3: Stage 2 Discharge Pressure (Also total pump pressure).

Some parts/diameters are labeled:

1. Shaft/Shaft Sleeve
2. Stage 1 wear ring diameter
3. Stage 1 Impeller
4. Stage 2 Impeller
5. Stage 2 wear ring diameter Similar parts in Figures are labeled with similar reference numerals and labels for consistency.

Every lead line and associated reference label for every element is not included in every Figure of the drawing to reduce clutter in the drawing as a whole.

DETAILED DESCRIPTION OF THE INVENTION

FIG. 2 shows part of an opposed impeller arrangement I (see FIG. 5) having an impeller stage 2 configured with a wear ring undercut, according to some embodiments of the present invention. FIGS. 2 and 5 also show other parts that are similar to that shown in FIGS. 1 and 4 and that are labeled with similar reference numerals and labels for consistency.

FIG. 5 shows the opposed impeller arrangement I in further detail, e.g., having the stage 1 wear ring, the stage 2 wear ring, the impeller stage 1, and the impeller stage 2, all arranged on the pump shaft, along with a wear ring undercut formed or configured between the stage 2 wear ring and the impeller stage 2.

As one skilled in the art would appreciate, the total axial thrust produced by a two stage opposed impeller pump is generated because of a difference of the pressures exposed in the areas between the first and second stage impellers and the increase in head as you go from one stage to the next. By keeping the same wear ring diameter and introducing an undercut to the second stage, a step is created that will help to balance some of the pressures generated from the second stage, e.g., consistent with that shown in FIGS. 2 and 5. For example, see the arrow pointing to the wear ring undercut in FIGS. 5 and 5A. The second stage sees an increased pressure due to the fact that it is receiving the pressure generated by the discharge of the first stage. This step or undercut on the second stage will help to increase the thrust on the opposite side of the direction of incoming flow from the first stage into the second stage inlet. Also by having this step or undercut, it allows the use of the same type of wear ring. Using the same wear ring will reduce the amount of inventory on hand as well as any mistakes that could happen during assembly/disassembly. Also it may reduce the need for any complex machining in the casing. By balancing axial forces, the thrust absorbing bearing system may be reduced. If the bearing system is retained without reduction, it will improve reliability. If the bearing system is reduced, both cost of the bearing and power loss within the bearing will be reduced. Reduction of power can lead to gains in efficiency.

The Stage 2 impeller (aka "impeller stage 2") also has a higher pressure and flow delivered since it receives pressure and flow from Stage 1, therefore this second stage generates a pressure rise approximately equal to that of the first stage. In the conventional 2 stage design, e.g., like that shown in FIGS. 1 and 4, the second stage has a higher thrust generated, with no way of balancing the unequal pressures. To balance this higher pressure, the impeller wear ring undercut according to the present invention on the second stage is receiving the total pressure, which will help to offset some of the pressure going into the inlet of the second stage.

In the present invention, the wear ring undercut shown in FIGS. 2, 5 and 5A allows a pressure opposite that of the pressure of the incoming flow into the inlet of the impeller. Based upon a CFD analysis of the wear ring undercut according to the present invention, there is a higher pressure entering Stage 2, causing an imbalance, e.g., consistent with that shown in FIG. 3. The wear ring undercut according to the present invention allows the total pressure to enter behind the wear ring undercut, thus creating a pressure opposite that of the incoming Stage 2 pressure, e.g., consistent with that shown in the CFD analysis in FIG. 3. This in turn will be another balancing method to help reduce the overall generated axial thrust in the pump, e.g., along the axis of the shaft in FIG. 5. As the thrust is balanced, the thrust absorbing bearing system may be reduced. If the bearing system is reduced, the cost of the bearings and power loss within the bearing system will be reduced. A reduction in power can lead to gains in efficiency. If the original bearing system is retained without a reduction, it will improve overall reliability.

FIGS. 2 and 5

By way of example, the present invention may be implemented an opposed impeller arrangement, e.g., for using in an opposed impeller pump, featuring a combination of a stage 1 impeller arrangement and a stage 2 impeller arrangement having opposing impellers and different impeller and wear ring arrangements, e.g., like that shown in FIGS. 2 and 5.

The stage 1 impeller arrangement may include the stage 1 impeller and the stage 1 wear ring, and be configured to receive an input fluid flow and a pump stage 1 fluid flow, e.g., like that shown in FIGS. 2 and 5.

The stage 2 impeller arrangement may include the stage 2 impeller and the stage 2 wear ring configured to receive the pump stage 1 fluid flow and provide a pump stage 2 fluid flow, and may also include the stage 2 wear ring undercut configured between the stage 2 impeller and the stage 2 wear ring to offset generated axial thrust in the opposing impeller pump, based upon the different impeller and wear ring arrangements, e.g., like that shown in FIGS. 2 and 5.

Consistent with that best shown in the exploded view in FIG. 5A, the stage 2 wear ring may include a stage 2 outer circumferential wear ring surface $S_1$ arranged between opposing stage 2 planar wear ring surfaces $S_2$ and $S_3$, with one opposing stage 2 planar wear ring surface $S_2$ facing away from the stage 2 impeller, and the other opposing stage 2 planar wear ring surface $S_3$ facing towards the stage 2 impeller. The stage 2 impeller may be configured with a stage 2 curved impeller surface $S_4$ and a stage 2 impeller circumferential surface $S_5$, where the stage 2 curved impeller surface $S_4$ slopes from the stage 2 impeller circumferential surface $S_5$, towards the stage 2 wear ring, and meets the stage 2 wear ring on the one opposing stage 2 planar wear ring surface $S_3$ facing the stage 2 impeller so as to form the stage 2 wear ring undercut, e.g., consistent with that shown in FIGS. 2, 5 and 5A.

The stage 2 outer circumferential wear ring surface $S_1$ may have an outer diameter; and the stage 2 wear ring undercut may have a corresponding outer diameter that is less than the outer diameter of the outer circumferential wear ring surface $S_1$, e.g., so as to form an undercut as shown.

In contrast to the stage 2 impeller arrangement, and consistent with that shown in FIG. 5, the stage 1 wear ring may include a stage 1 outer circumferential wear ring surface $S_{1'}$ arranged between opposing stage 1 planar wear ring surfaces $S_{2'}$ and $S_{3'}$, where both opposing stage 1 planar wear ring surfaces $S_{2'}$ and $S_{3'}$ are facing away from the stage 1 impeller, e.g., as shown in FIG. 5. The stage 1 impeller may be configured with a stage 1 curved impeller surface $S_{4'}$ and a stage 1 impeller circumferential surface $S_{5'}$, where the stage 1 curved impeller surface $S_{4'}$ slopes from the stage 1 impeller circumferential surface $S_{5'}$, towards the stage 1 wear ring, but does not meet the stage 1 wear ring on any stage 1 planar wear ring surface facing towards the stage 1 impeller. In other words, the stage 1 impeller arrangement does not include a wear ring undercut.

Figure 6:
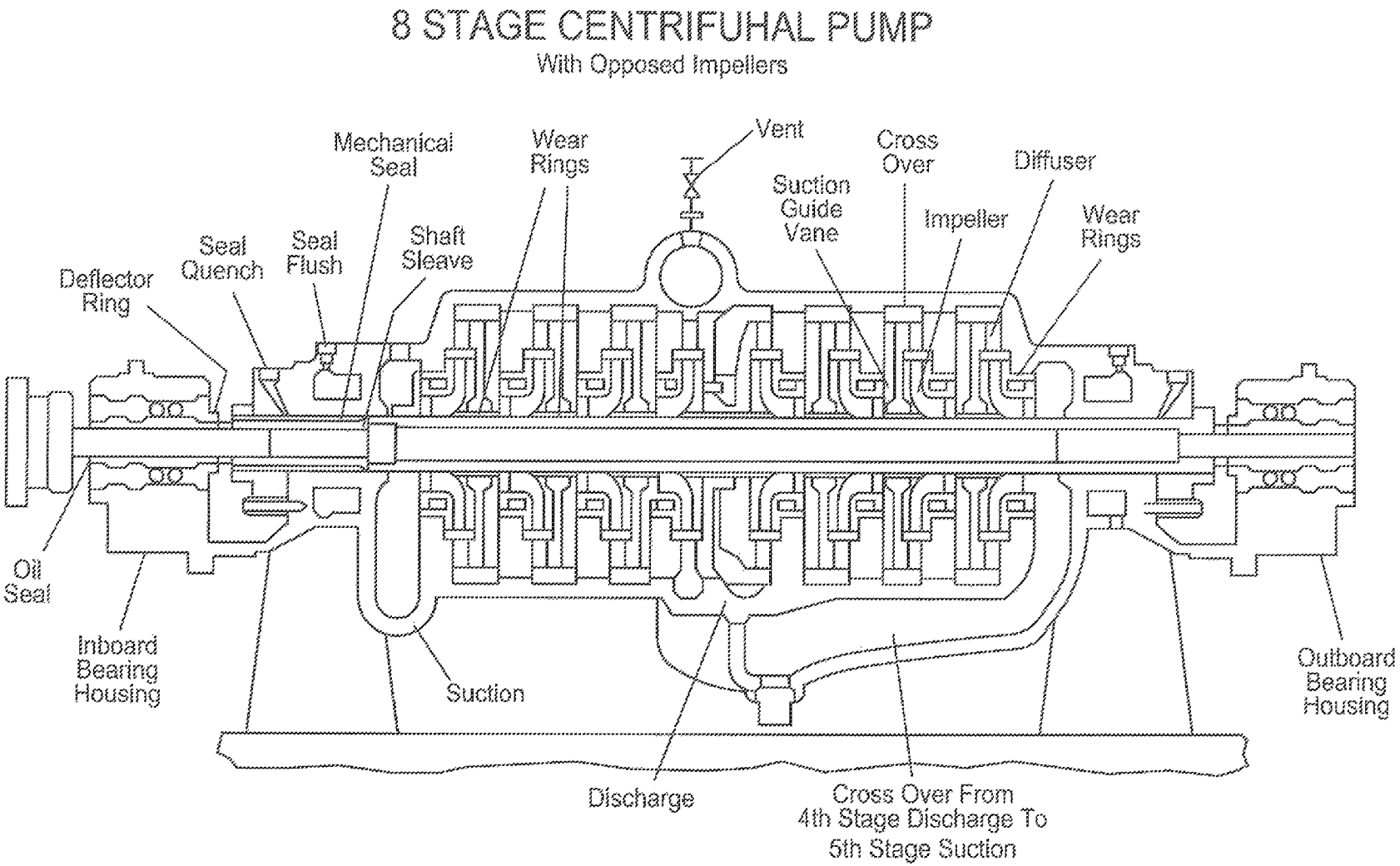
FIG. 6 (PRIOR ART)
FIG. 6 shows a cross-sectional view of an 8 stage centrifugal pump with opposed impellers that is known in the art.

FIG. 6: The Multistage Pump

By way of example, FIG. 6 shows an 8 stage centrifugal pump with opposed impellers that is known in the art and in which the present invention may be implemented. However, the scope of the invention is not intended to be limited to implementing the present invention in any particular type or kind of multistage pump. For example, the scope of the invention is intended to include implementing the present invention in other types or kind of pumps either now known or later developed in the future, e.g., including other types or kinds of pumps having fewer than 8 stages or more than 8 stages.

The Interchangeable Terminology

It is noted for the sake of completeness that the terms "stage 1 wear ring" and "wear ring stage 1", the terms "stage 2 wear ring" and "wear ring stage 2", the terms "stage 1 impeller" and "impeller stage 1", and the terms "stage 2 impeller" and "impeller stage 2", may be and/or are all used interchangeably herein. Similar, the term "stage 2 wear ring undercut" and "wear ring undercut" also may be and/or are also used interchangeably herein.

Applications

By way of example, possible applications of the present invention may include its use in relation to one or more of the following:

Pumps,

Fans,

Blowers and

Compressors.

Computational Fluid Dynamics (CFD)

Computational fluid dynamics (CFD) is a branch of fluid mechanics that uses numerical analysis and algorithms to solve and analyze problems that involve fluid flows. Computers are used to perform the calculations required to simulate the interaction of liquids and gases with surfaces defined by boundary conditions.

THE SCOPE OF THE INVENTION

Further still, the embodiments shown and described in detail herein are provided by way of example only; and the scope of the invention is not intended to be limited to the particular configurations, dimensionalities, and/or design details of these parts or elements included herein. In other words, a person skilled in the art would appreciate that design changes to these embodiments may be made and such that the resulting embodiments would be different than the embodiments disclosed herein, but would still be within the overall spirit of the present invention.

It should be understood that, unless stated otherwise herein, any of the features, characteristics, alternatives or modifications described regarding a particular embodiment herein may also be applied, used, or incorporated with any other embodiment described herein.

Although the invention has been described and illustrated with respect to exemplary embodiments thereof, the foregoing and various other additions and omissions may be made therein and thereto without departing from the spirit and scope of the present invention.

What we claim is:

1. An opposing impeller arrangement comprising:

a combination of a stage 1 impeller arrangement and a stage 2 impeller arrangement having identical opposing impellers and wear rings;

the stage 1 impeller arrangement having a stage 1 impeller and a stage 1 wear ring, and being configured to receive an input fluid flow and a pump stage 1 fluid flow; and the stage 2 impeller arrangement having a stage 2 impeller and a stage 2 wear ring configured to receive the pump stage 1 fluid flow and provide a pump stage 2 fluid flow, the stage 2 wear ring and the stage 1 wear ring having the same wear ring diameter, and also having a stage 2 wear ring undercut configured between the stage 2 impeller and the stage 2 wear ring to offset generated axial thrust in a multistage opposed impeller pump.

2. An opposing impeller arrangement according to claim 1, wherein the stage 2 wear ring comprises a stage 2 outer circumferential wear ring surface arranged between opposing stage 2 planar wear ring surfaces, one opposing stage 2 planar wear ring surface facing towards the stage 2 impeller; and the stage 2 impeller is configured with a stage 2 curved impeller surface that slopes towards and meets the stage 2 wear ring on the one opposing stage 2 planar wear ring surface facing the stage 2 impeller so as to form the stage 2 wear ring undercut.

3. An opposing impeller arrangement according to claim 2, wherein the outer circumferential wear ring surface has an outer diameter; and the stage 2 wear ring undercut has a corresponding outer diameter that is less than the outer diameter of the outer circumferential wear ring surface.

4. An opposing impeller arrangement according to claim 2, wherein the stage 1 wear ring comprises a stage 1 outer circumferential wear ring surface arranged between opposing stage 1 planar wear ring surfaces, where both opposing stage 1 planar wear ring surfaces are facing away from the stage 1 impeller; and the stage 1 impeller is configured with a stage 1 curved impeller surface that slopes towards but does not meet the stage 1 wear ring on any stage 1 planar wear ring surface facing towards the stage 1 impeller.

5. A multistage opposed impeller pump comprising:

a combination of a stage 1 impeller arrangement and a stage 2 impeller arrangement having identical opposing impellers and wear rings;

the stage 1 impeller arrangement having a stage 1 impeller and a stage 1 wear ring, and being configured to receive an input fluid flow and a pump stage 1 fluid flow; and the stage 2 impeller arrangement having a stage 2 impeller and a stage 2 wear ring configured to receive the pump stage 1 fluid flow and provide a pump stage 2 fluid flow, the stage 2 wear ring and the stage 1 wear ring having the same wear ring diameter, and also having a stage 2 wear ring undercut configured between the stage 2 impeller and the stage 2 wear ring to offset generated axial thrust in the multistage opposed impeller pump.

6. A multistage opposed impeller pump according to claim 5, wherein the stage 2 wear ring comprises a stage 2 outer circumferential wear ring surface arranged between opposing stage 2 planar wear ring surfaces, one opposing stage 2 planar wear ring surface facing towards the stage 2 impeller; and the stage 2 impeller is configured with a stage 2 curved impeller surface that slopes towards and meets the stage 2 wear ring on the one opposing stage 2 planar wear ring surface facing the stage 2 impeller so as to form the stage 2 wear ring undercut.

7. A multistage opposed impeller pump according to claim 6, wherein the outer circumferential wear ring surface has an outer diameter; and the stage 2 wear ring undercut has a corresponding outer diameter that is less than the outer diameter of the outer circumferential wear ring surface.

8. A multistage opposed impeller pump according to claim 7, wherein the stage 1 wear ring comprises a stage 1 outer circumferential wear ring surface arranged between opposing stage 1 planar wear ring surfaces, where both opposing stage 1 planar wear ring surfaces are facing away from the stage 1 impeller; and the stage 1 impeller is configured with a stage 1 curved impeller surface that slopes towards but does not meet the stage 1 wear ring on any stage 1 planar wear ring surface facing towards the stage 1 impeller.

9. A multistage opposed impeller pump according to claim 5, wherein the stage 1 wear ring and the stage 2 wear ring have the same diameter.

10. A multistage opposed impeller pump according to claim 5, wherein the stage 2 impeller is configured with a stage 2 curved impeller surface that slopes towards and meets the stage 2 wear ring on one of two opposing stage 2 planar wear ring surfaces so as to form the stage 2 wear ring undercut.

* * * * *